US007364427B2

(12) United States Patent
Huang et al.

(10) Patent No.: US 7,364,427 B2
(45) Date of Patent: Apr. 29, 2008

(54) LABORSAVING AND SAFETY LIGHTERS

(75) Inventors: Xinhua Huang, Zhejiang Province (CN); Zhengrong Wang, Shanghai (CN)

(73) Assignee: Ningbo Xinhai Electronics Manufacture Co., Ltd. (CN)

( * ) Notice: Subject to any disclaimer, the term of this patent is extended or adjusted under 35 U.S.C. 154(b) by 208 days.

(21) Appl. No.: 10/515,390

(22) PCT Filed: May 21, 2003

(86) PCT No.: PCT/CN03/00373

§ 371 (c)(1),
(2), (4) Date: Nov. 22, 2004

(87) PCT Pub. No.: WO03/098113

PCT Pub. Date: Nov. 27, 2003

(65) Prior Publication Data

US 2005/0170303 A1 Aug. 4, 2005

(30) Foreign Application Priority Data

May 22, 2002 (CN) ..... 02 2 17614
Mar. 12, 2003 (CN) ..... 03 2 29480

(51) Int. Cl.
*F23Q 2/08* (2006.01)
*F23D 11/36* (2006.01)

(52) U.S. Cl. ..... 431/129; 431/153

(58) Field of Classification Search ..... 431/344, 431/153, 255, 254

See application file for complete search history.

(56) References Cited

U.S. PATENT DOCUMENTS 3,782,885 A * 1/1974 Weissmann ..... 431/255
4,098,309 A * 7/1978 Mohr ..... 141/291
5,378,143 A * 1/1995 Ansquer ..... 431/153
5,531,591 A * 7/1996 Yamazaki ..... 431/153
6,135,761 A * 10/2000 Chen ..... 431/132
6,454,560 B1 * 9/2002 Chen ..... 431/153
6,755,642 B2 * 6/2004 Zhang ..... 431/153

* cited by examiner

*Primary Examiner*—Steve McAllister
*Assistant Examiner*—Chuka C Ndubizu
(74) *Attorney, Agent, or Firm*—Ostrolenk, Faber, Gerb & Soffen, LLP

(57) ABSTRACT

This invention relates to a laborsaving lighter, and more particularly relates to a laborsaving and safe lighter, which includes a casing (101), and a piezoelectric assembly and a gas emitting assembly disposed in the casing. The piezoelectric assembly includes a piezoelectric push rod (104) and a button (105). A vertical slot opening (106) is formed in the end face of the button (105), and a safety piece (107) is disposed in the slot opening (106). There is a rock arm (109) between the gas emitting assembly and the safety piece (107). In the lighter's non-operative state, the upper end of the rock arm (109) rests against the lower part (107*a*) of the safety piece (107). The middle part of the rock arm is contacted with the piezoelectric push rod (104), and the lower end of the rock arm is connected pivotally to the inner surface of the casing (101). According to the principle of lever, the present invention is laborsaving as well as safety. The action of depressing the button is laborsaving and convenient, and the travel path of the button is effectively controlled. It avoids the phenomena of igniting the inflammable gas or gas leakage with by directly depressing the button pressed downward directly or gas leakage due to the button being accidentally pressed, and improves the lighter's safety by the prevention of misoperation and the increase of operation difficulties for children.

7 Claims, 6 Drawing Sheets

LABORSAVING AND SAFETY LIGHTERS

TECHNICAL FIELD

This invention relates to an electronic lighter and more particularly to a force reduction device of a lighter; and this invention also relates to a laborsaving lighter with a safety device disposed on the lighter's button.

BACKGROUND OF THE INVENTION

The existing electronic lighters are a kind of electronic ignition device that uses an inflammable gas such as butane or natural gas as fuel. Such a lighter includes a casing, a fuel tank in the casing, a piezoelectric assembly, a gas emitting assembly and a windshield over the gas emitting assembly. The gas emitting assembly includes a gas emitting nozzle, a gas emitting valve and a flame-adjusting ring. The piezoelectric assembly includes a piezoelectric element, a piezoelectric push rod and a button. A linkage pry board is disposed between the gas emitting assembly and the piezoelectric assembly. The operation principle is as follows: by pressing downwards the button with your thumb, the button or a connecting member substantially vertical to the button pushes the piezoelectric push rod to strike against the piezoelectric element which then generates voltage, and at the same time, the button also pushes the linkage pry board to open the gas emitting valve, whereby the gas is lighted up. Because the button acts directly on the upper end of the piezoelectric push rod, it needs to apply a larger external force to push the button. Therefore, it is laborious to operate the currently available lighters.

As shown in FIG. 1, the currently available lighters are in a straight-log structure, and their major shortcoming is that the piezoelectric switch 7' and the lighter button 1' are relatively fixed, therefore, it needs a relatively stronger force to press the button 1'. The working force of the electronic (piezoelectric) lighter is about 2 kg~2.5 kg. Therefore, the acting force on the button 1' should be over 2.5 kg in order to light up the electronic lighter. That's why it is generally believed that the currently available piezoelectric lighters are hard to operate and are not dexterous for lighting-up. It is impossible to reduce the force needed to press the button of the currently available piezoelectric lighters because of their structure constraints.

Besides, the above-mentioned lighters do not have any safety assembly, and there is no restriction of downwards pressing the button. The lighter is very likely ignited when the button is accidentally pressed in children's play or struck by a hard object accidentally, which will do harm to children or even threaten the public security. Further more, when the button is accidentally pressed by an external force, the gas emitting valve is opens and the inflammable gas leaks. This is a potential safety hazard, though it might not cause a flame appear. Therefore, it is clearly prohibited in some regions and countries to manufacture and sell the lighters without a safety device.

SUMMARY OF THE INVENTION

The purpose of the invention is to provide a laborsaving lighter which can improve the feeling of operation of electronic (piezoelectric) straight-log lighters so that it becomes dexterous and easy to press the lighter's button.

Another purpose of this invention is to provide a safe and laborsaving lighter which saves labor in operation and is equipped with a safety device. It can reduce the force needed to light up the lighter, and can effectively control the button's working state such that the button cannot be pressed downwards directly to improve the safety of the lighter and eliminate the aforesaid potential hazards.

This invention provides a force reduction device for an electronic lighter, comprising a lever device having an active force part working as a force point and a fixed part working as a fixed point at each of its ends respectively, and a middle part with a depressing point, wherein said fixed part is pivotally connected with the lighter's casing, said active force part is adjacent to the lighter's button, and said depressing point of the middle part of the lever device is adjacent to a piezoelectric switch.

A connecting rod is further disposed between said lever device and said button, wherein one end of the connecting rod is pivotally connected with said active force part at the force point thereof, and the other end of said connecting rod device is adjacent to the button.

A long and thin elongated bar is disposed on the end of the connecting rod that is adjacent to the button.

A concave cambered surface is disposed in the inner surface of the button, and said concave cambered surface is of point contact with said elongated bar.

The ratio between the distance L from the elongated bar to the lever device's fixed point and the distance $L_6$ from the lever device's depressing point to the fixed point ($L/L_6$) is any selected from the range between 1.2 to 3.

This invention also provides a lighter which comprises: a casing, and a piezoelectric assembly and a gas emitting assembly in the casing, wherein said piezoelectric assembly includes a piezoelectric push rod and a button. The lighter also comprises a lever device with an active force part working as a force point and a fixed part working as a fixed point at each of its ends respectively, and a middle part with a pivot point, wherein said fixed point part is pivotally connected with the lighter's casing, said active force part is adjacent to the lighter's button, and said depressing point of the middle part of the lever device is adjacent to a piezoelectric switch.

Since the invention adopts a leverage device to control the depressing piezoelectric switch, in order to ignite the electronic (piezoelectric) lighter, the product of the force P applied on the button and its arm of force L, i.e., P×L (work done at a certain instant moment) should be equal to the product of the depressing force Po on the piezoelectric switch without the lever device (in a currently available electronic lighter) and its arm of force Lo (work done at a certain instant moment) Po×Lo, i.e., P×L=Po×Lo That is: P=Po×Lo/L In which:

P is the force applied on the button by the lever device of this invention;

Po is the force applied on the button of the currently available straight-log lighters;

L is the distance from the elongated bar of button-to-connecting rod to the lever's fixed point in the lever device of this invention.

Lo is the distance from the button's force point to the lever's fixed point of the currently available straight-log lighters.

If L of the lever device adopted in this invention is double of Lo of the currently available straight-log lighters, then input $L=2L_0$ into the above formula: P=Po×Lo/2L=Po×Lo/2Lo=Po/2, i.e., the force (P) applied on the button by the lever device in this invention—is only half of that applied on the currently available electronic (piezoelectric) straight-log lighters (Po).

And $P=P_{6\times}L_6/L$

In which:

$P_6$ is the force applied on the middle depressing point of the lever by the lever device in this invention.

$L_6$ is the distance from the lever's middle depressing point of the lever device in this invention to its fixed point.

Therefore, in the actual design and manufacture, the best effect of force reduction for the lighter in this invention can be achieved with rational arrangement of the arm of force of the lever device and the distance between the fixed point and the middle depressing point.

Compared with the prior arts, the advantages of this invention are that it dramatically approves the feeling of operation of the lighter, and makes the pressing operation on the lighter's button becomes comfortable, dexterous and easy.

This invention also provides a safe and laborsaving lighter, which comprises: a casing which a piezoelectric assembly and a gas emitting assembly are disposed within, the piezoelectric assembly including a piezoelectric push rod and a button, and said button having a slot opening in which a safety piece is disposed; and a rock arm between the safety piece and a gas emitting assembly. At a non-operating state, the rock arm is aligned with the lower part of the safety piece, the middle part of the rock arm is adjacent to a piezoelectric push rod, and the lower end of the rock arm is pivotally connected on the inner wall of the casing.

The laborsaving lighter takes the lower end of the rock arm as the depressing point, which, working on lever principle, can dramatically reduce the active force needed to strike the lighter with your thumb, thus the laborsaving purpose is realized. In the normal state, the upper end of the rock arm rests against the safety device and limits the movement of the safety device, and the button can be neither pressed, which ensures that neither the piezoelectric assembly nor the gas emitting assembly can be activated. Therefore, it is impossible to ignite the inflammable gas, and the purpose of the invention's safety is realized. Before you strike the lighter, move the safety device so that the safety device disengages from the upper end of the rock arm, then press the button, the rock arm is driven to move so that both the piezoelectric push rod and pry board move downwards together. When the button reach the working stroke, the piezoelectric assembly and the gas emitting valve assembly start to work to ignite the inflammable gas. Upon completion of lighting-up operation, the lighter can reset its safety device with the force of the return spring.

The upper end of said rockerarm has a protrusion which contacts the lower part of the said safety device. Or in another example, said rocker arm has a protrusion on each side of its upper end, wherein one of the protrusions is adjacent to the lower part of said safety device. An open slot is formed between the two protrusions and the width of the open slot is not less than that of the safety device's lower part. In lighting-up operation, move the safety device till it disengages from the protrusion of the upper end of the rock arm, then press the button to drive the rock arm, and the inflammable gas is ignited.

At the middle of said rock arm, there is an L-shaped notch mating with the head of the piezoelectric push rod.

Horizontal movement of the safety device and downward press of the button are two actions in different directions, and are different from normal operation practice, so it helps increase safety of the lighter.

Relying on lever principle, the invention realizes both the purposes of laborsaving and safety. It is light and handy to press the button with the button's stroke effectively controlled. It avoids the phenomena of igniting the inflammable gas by directly depressing the button or gas leakage due to the button being accidentally pressed, and improves the lighter's safety by the prevention of misoperation and the increase of operation difficulties for children.

BRIEF DESCRIPTION OF THE DRAWINGS

The invention will be described in detail with reference to particular examples and the accompanying drawings, in which.

DETAILED DESCRIPTION OF THE INVENTION

The following is the further detailed description of the invention with reference to the examples in the accompanying drawings:

EXAMPLE 1

Figure 1:
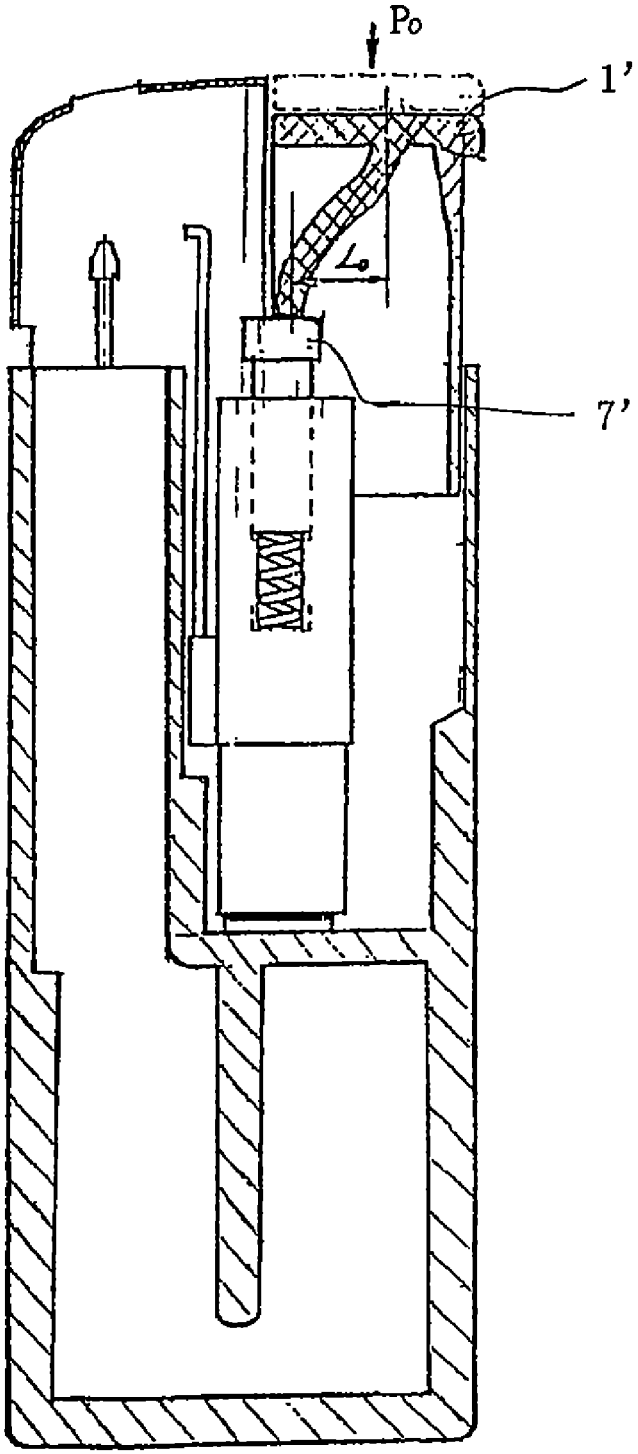
FIG. 1 is the structure illustration of a currently available lighter.
Figure 2:
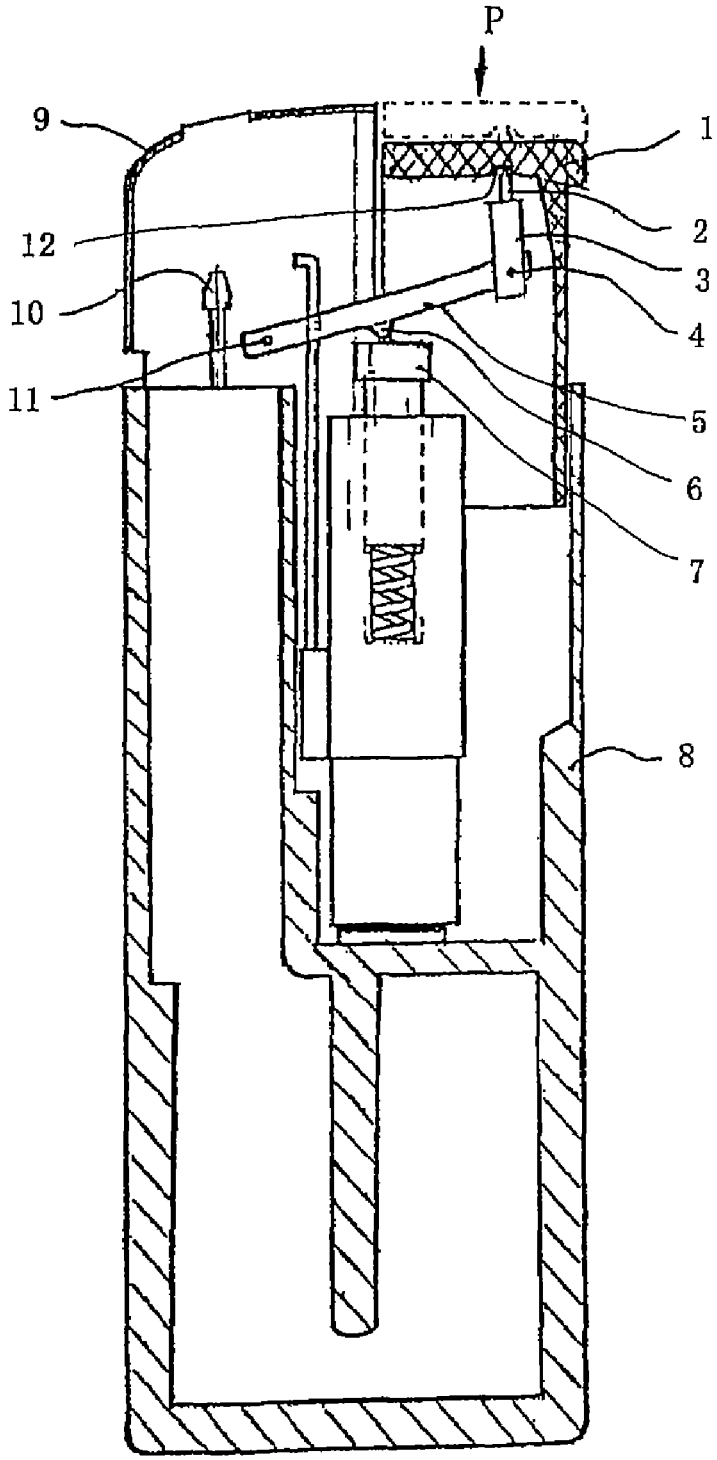
FIG. 2 is the structure illustration of the lighter with the force-reduction device according to example 1 of the invention.
Figure 3:
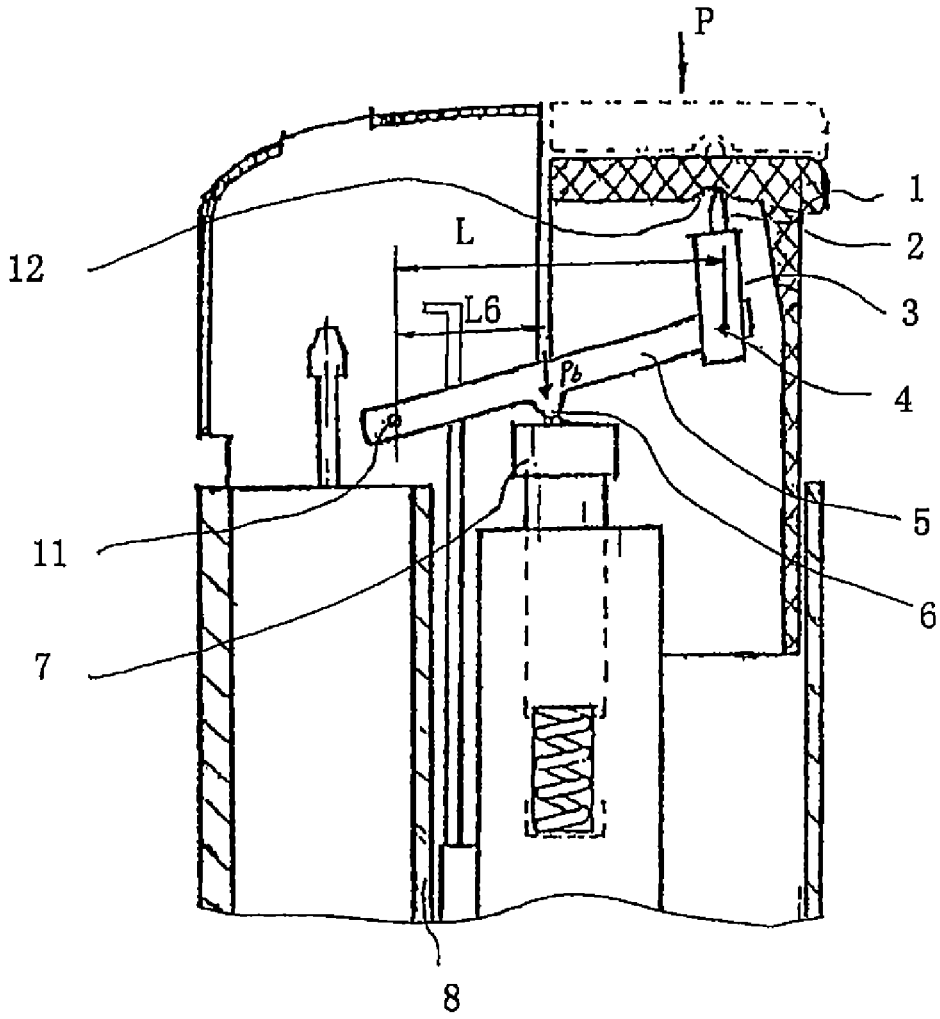
FIG. 3 is the moment transfer illustration for the lever and the connecting rod according to example 1 of the invention.
Figure 4:
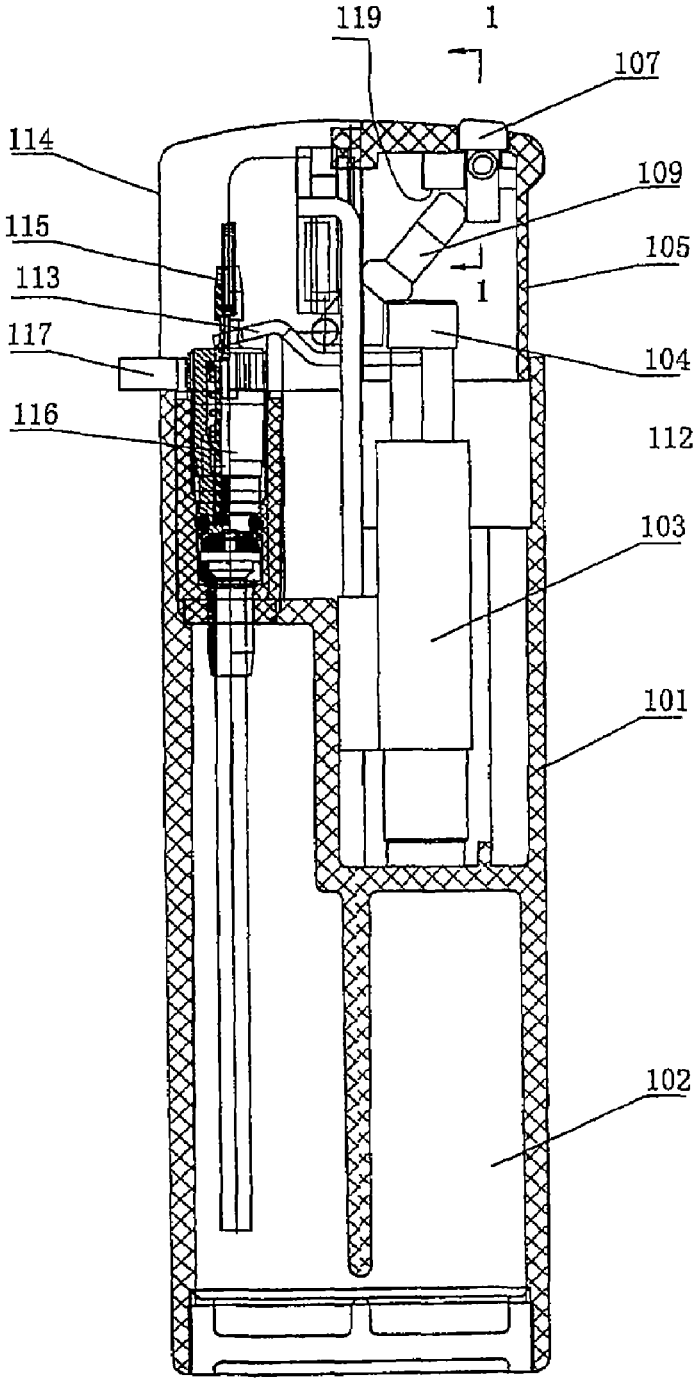
FIG. 4 is the illustration of the safe and laborsaving lighter in the normal state, according to example 2 of the invention.
Figure 4A:
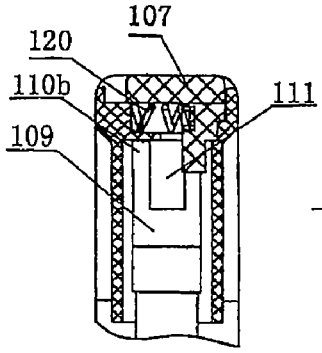
FIG. 4*a* is a section view of the normal state safety piece taken along line 1-1 in FIG. 4.
Figure 4B:
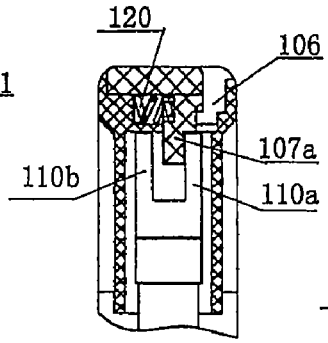
FIG. 4*b* is a section view of the safety piece taken along line 1-1 in FIG. 4 after the safety piece is shifted horizontally.
Figure 5A:
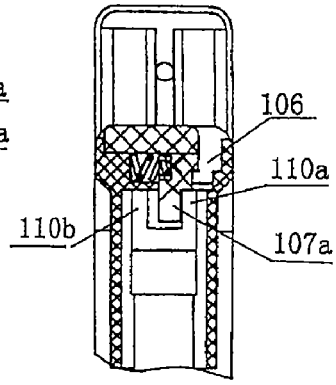
FIG. 5*a* is a section view of the safety piece taken along line 2-2 in FIG. 5 when the safety piece is in operation.
Figure 6:
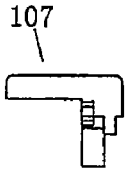
FIG. 6 is the structure illustration of the safety piece, according to example 2 of the invention.
Figure 7:
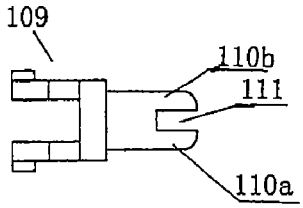
FIG. 7 is the structure illustration of the safe and laborsaving lighter's rocker arm, according to example 2 of the invention.

FIG. 2 and FIG. 3 illustrate a particular example of this invention. As shown in FIG. 2, all components of the lighter's force reduction device are enclosed in a casing 8. The force reduction device comprises a lever 5, and there is an active force part 4 with a force point and a fixed part 11 with a fixed point respectively on each end of lever 5, and a middle part 6 with a depressing point. The active force part 4 in an end of the lever 5 is pivotally connected to an end of a connecting rod 3 by a pin (not illustrated). The force point on the lever 5 functions as a pivot for moment transfer. There is a long and thin elongated bar 2 at the other end of the connecting rod 3, and the elongated bar can be named as an elongated bar of button-to-connecting rod.

The elongated bar 2 contacts with a concave cambered surface 12 of the button 1. The cambered surface 12 and the elongated bar of button-to-connecting rod 2 can be in spot contact or adjacent, which is designed to ensure the optimum dexterity for the lever device of this invention. The other end's fixed point 11 of the lever 5 is connected pivotally to the lighter's casing of this example. Pins or other suitable means can be adopted to fix them.

The middle part 6 of the lever 5 is adjacent directly to a piezoelectric switch 7. When you depress the button 1 to ignite the lighter, the concave cambered surface 12 of the button 1 transfers the force to the elongated bar 2 of the connecting rod 3, which then drives lever 5 to swing around the fixed point of the fixed part 11 with the downward active force. The middle part 6 of the lever 5 depresses the piezoelectric switch 7 directly. At the same time, the inflammable gas is emitted from a gas emitting nozzle 10 and ignited by the igniting device (not illustrated). Windshield 9 functions to protect the lighter's flame from wind.

See also FIG. 3. The distance between elongated bar of button-to-connecting rod 4 and the lever's fixed point 11 is L, and the distance between the lever's middle depressing point 6 and the fixed point 11 is L6. The ratio L/L6 is from 1.2 to 3.

This invention adopts a lever device to control the piezoelectric switch 7. Therefore, the optimum effect for the lighter's force reduction device of the invention can be achieved, which makes operation of the lighter comfortable, dexterous and light. The ratio (L/L6) between arm of force L and the said distance L6 can be set between 1.2~3, and can be adjusted according to the factors like the lighter's structure, and etc.

EXAMPLE 2

As shown in FIGS. 4-7, the example is a safe and laborsaving lighter, which is another preferred examples of the invention.

As shown in FIGS. 4-7, the lighter comprises a casing 101, a fuel tank 102 in the casing 101, a piezoelectric assembly and a gas emitting assembly, as well as windshield 114 over the gas emitting assembly. The casing 101 serves as the fuel tank wall. The piezoelectric assembly comprises a piezoelectrics element 103, a piezoelectric push rod 104 and a button 105. The gas emitting assembly consists of a gas emitting nozzle 115, a gas emitting valve 116 and an adjustment ring 117. There is a pry board 113 between the gas emitting assembly and the piezoelectric assembly for linkage of them. In the end face of button 105, there is a vertical slot opening 106 which receives an L-shaped safety piece 107. There is a return spring 120 between the sidewall of the safety piece 107 and the button 105. There is a rock arm 109 above the pry board 113 to the safety piece 107.

On each side of the upper end of the rocker arm 109 there is respectively a protrusion 110*a* and 110*b*. The lower part 107*a* of the safety piece 107 rests against the right protrusion 110*a* of the rock arm 109. A open slot 111 is formed between the two protrusions 110*a* and 110*b*, and the width of the open slot is suitable for that of the lower part 107*a* of the safety piece 107. On the middle of the rock arm 109, there is an L-shaped notch 112 which is adjacent to or against the piezoelectric push rod 104. The lower end of the rock arm 109 is fixed pivotally to the inner wall of casing 101 by pin 121.

There is a downward plane 109 in the safety piece's in the end face of the button 105. The plane 119 functions to press the rock arm 109 when the button moves downwards.

When the return spring 120 rests in the normal or non-operation mode, the right protrusion 110*a* at the upper end of the rock arm 109 rests against the downward plane 119 of the safety piece 107, which limits the clockwise rotation of the rock arm 109 around the shaft 121. Therefore, the button 105 cannot be depressed, thus the piezoelectric push rod 104 and the pry board 113 cannot work. In lighting up operation or in the operation state, shift the safety piece 107 horizontally, and return spring 120 is compressed; the lower part 107*a* of the safety piece 107 disengages from the protrusion 110*a* on the upper end of rock arm 109 and enters the open slot 111 between the protrusions 110*a* and 110*b*. At this moment, when you depress the button 105, it drives the rock arm 109 to turn clockwise around the shaft 121. At this moment, the top of the short side of the L-shaped notch 112 at the middle of the rock arm 109 functions as a depressing point for the lever that pushes the piezoelectric push rod 104 and pry board 113 to move downwards following the rotation. With the stroke, the piezoelectric push rod 104 and the pry board 113 start to work, and then the gas is ignited. When the button 105 is released, return spring 120 resets the safety piece 107, and at the same time, the pry board 113 and the rock arm 109 are reset by the return force of the piezoelectric push rod 104, and the lighter resets to the normal state (i.e., the safe state).

In the above structure, other springs, such as tensioned spring, or other return means can be adopted.

The above-mentioned structure in this example gives general considers to the lighter's safety and laborsaving effect. If just for laborsaving, the example can omit the above-mentioned safety device, and adopt the structure of the rock arm 109 independently. The upper end of the rock arm 109 contacts or is adjacent to the button directly, and the rock arm is depressed to ignite the lighter when the button is pushed. In such a structure, the open slot on the upper end of the rock arm can be canceled, and instead, there should be a surface on the bottom of the button for mating with the upper end of the rock arm so that convenience and labor saving can be achieved when the rock arm moves relative to the button. In this structure, the rock arm is like the lever in the example, and it can also be adjusted to achieve different labor-saving effects by adjusting the ratio of the distance between the shaft 121 and the upper end of the rock arm to the distance between the shaft 121 and the active force point where the rock arm presses the piezoelectric element.

EXAMPLE 3

Figure 8:
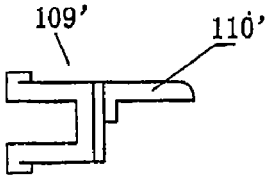
FIG. 8 is a schematic view of another structure of the rock arm according to example 3 of the invention.
Figure 5:
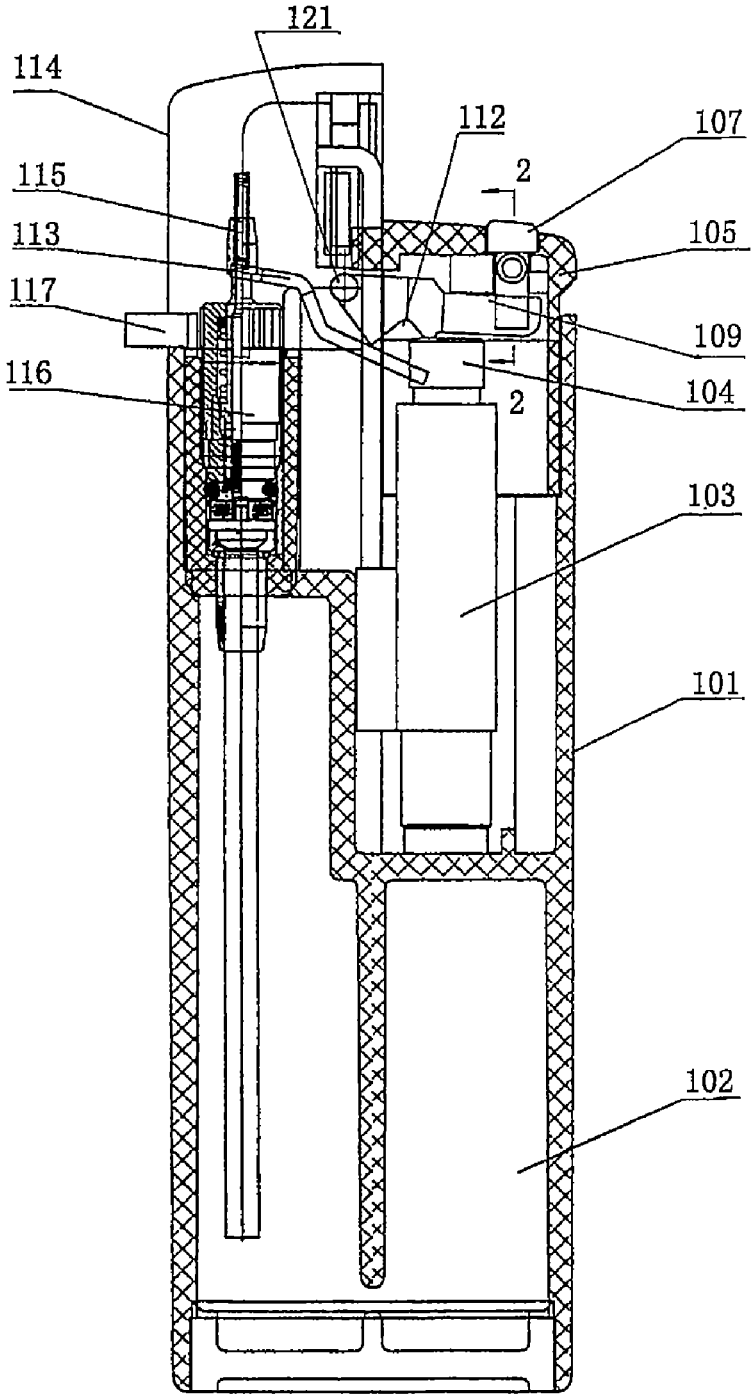
FIG. 5 is the illustration of the safe and laborsaving lighter in operation, according to example 2 of the invention.

See also FIG. 8. Example 3 is the same as example 2 but the rock arm. Rock arm 109' in this example adopts the structure as shown in FIG. 8. Compared with the rock arm 109 in example 2, the rock arm 109' in this example has only one protrusion 110' on its right side. In the normal state, the lower part 107*a* of the safety piece 107 rests on protrusion 110' of rock arm 109'. The other structure and operation principle in this example are the same as those in example 2.

The invention claimed is:

1. A safe and laborsaving lighter, comprising:

a casing, with a piezoelectric assembly and a gas emitting assembly disposed therein, where the piezoelectric assembly comprises a piezoelectric push rod and a button, the button having a slot opening in which a safety piece is disposed; and a rock arm between the gas emitting assembly and the safety piece, wherein in a non-operation state, the upper end of the rock arm stays against the lower part of the safety piece, the middle part of the rock arm is adjacent to the push rod, and the lower end is connected pivotally with the inner wall of the casing; and a return spring disposed between the sidewall of the safety piece and the button.

2. A safe and laborsaving lighter, comprising:

a casing, with a piezoelectric assembly and a gas emitting assembly disposed therein, where the piezoelectric assembly comprises a piezoelectric push rod and a button, the button having a slot opening in which a safety piece is disposed; and a rock arm between the gas emitting assembly and the safety piece, wherein in a non-operation state, the upper end of the rock arm stays against the lower part of the safety piece, the middle part of the rock arm is adjacent to the push rod, and the lower end is connected pivotally with the inner wall of the casing; and wherein a protrusion is formed on the upper end of the rock arm, and is adjacent to the lower part of the safety piece.

3. A safe and laborsaving lighter, comprising:

a casing, with a piezoelectric assembly and a gas emitting assembly disposed therein, where the piezoelectric assembly comprises a piezoelectric push rod and a button, the button having a slot opening in which a safety piece is disposed; and a rock arm between the gas emitting assembly and the safety piece, wherein in a non-operation state, the upper end of the rock arm stays against the lower part of the safety piece, the middle part of the rock arm is adjacent to the push rod, and the lower end is connected pivotally with the inner wall of the casing; and wherein either side of the upper end of the rock arm has a protrusion respectively, one of the two protrusions contacting with the lower part of the safety piece, an open slot being formed between the two protrusions and a width of the open slot being not less than that of the lower part of the safety piece.

4. The lighter in accordance with claim 1, wherein an L-shaped gap is formed at the middle part of the rock arm and is configured to match with the head of the piezoelectric push rod.

5. The lighter in accordance with claim 1 wherein the slot opening is vertically formed in the end face of the button.

6. The lighter in accordance with claim 2, wherein an L-shaped gap is formed at the middle part of the rock arm and is configured to match with the head of the piezoelectric push rod.

7. The lighter in accordance with claim 3, wherein an L-shaped gap is formed at the middle part of the rock arm and is configured to match with the head of the piezoelectric push rod.

* * * * *